United States Patent [19]

DeGroot

[11] Patent Number: 4,651,910

[45] Date of Patent: Mar. 24, 1987

[54] TAPE DISPENSER

[75] Inventor: Peter F. DeGroot, Monterey, Calif.

[73] Assignee: Bud Antle, Inc., Salinas, Calif.

[21] Appl. No.: 820,288

[22] Filed: Jan. 17, 1986

[51] Int. Cl.[4] ..... B26F 3/02

[52] U.S. Cl. ..... 225/1; 206/409; 206/411; 225/25; 225/48; 225/54

[58] Field of Search ..... 225/1, 25, 26, 44, 45, 225/48, 49, 50, 106, 54; 206/409, 411

[56] References Cited

U.S. PATENT DOCUMENTS 2,484,673 10/1949 Becker ..... 225/49

4,262,835 4/1981 Wrobel ..... 225/25

*Primary Examiner*—Frank T. Yost

*Assistant Examiner*—Hien H. Phan

*Attorney, Agent, or Firm*—Townsend and Townsend

[57] ABSTRACT

A tape dispenser for an agricultural/industrial environment having wind and dirt dispenses tape adhesive side upwardly exposed. Centrally of the dispenser there is placed a roll of tape conventionally wound in a spiral. The roll of tape has an outwardly exposed adhesive release surface and an inwardly exposed adhesive coated surface and is wound in a first direction. In the dispenser, the tape is threaded from the first direction of its spiral wound path to a reversed path around the roll in a second and opposite direction. Typically, the reversed path is defined over the surfaces of four rollers with the adhesive release side inwardly exposed to the rollers and the adhesive coated side outwardly exposed. The roll and reverse path are encased within a housing to prevent the outwardly exposed adhesive from adhering either to ambient dust or nearby objects. The tape passes free from the housing along a dispensing path to a convention severing tape knife. The dispensing path includes a section open to the interior of the casing which allows the adhesive release side of tape on the dispensing path to attach to a small portion of the exposed adhesive on the reversed path. Thus, the tape is held by adhesive at the adhesive release coating and can be dispensed from the dispensing path and firmly held in the vicinity of the severing knife when tape is severed.

5 Claims, 6 Drawing Figures

TAPE DISPENSER

This invention relates to a tape dispenser. More particularly a tape dispenser for an agricultural/industrial environment is disclosed wherein the tape is dispensed adhesive side up.

Summary Of The Relevant Literature

Tape dispensers are old and well known. Typically the commonest type of tape dispenser is designed for dispensing tape adhesive side down. Tape is disposed on a spiral wound roll with the adhesive coated side inwardly exposed and an adhesive release surface outwardly exposed. Tape is threaded from the spiral wound roll to the vicinity of a serrated knife. A short ledge at the roll disposed edge of the serrated knife allows the tape to be held in the vicinity of the knife. Provided the tape is dispensed adhesive side towards the knife with the non-sticky adhesive release side away from the knife, dispensing can occur.

There is a need to dispense tape adhesive side up to and towards the user. Devices are known for such dispensing. Typically, these devices rely on an electrostatic attraction of the adhesive release surface.

In many environments, such tape dispensers are unsatisfactory. Specifically, the tape is released from its dispensing path and becomes entangled either with itself or objects near the dispensing path. As a result, tape is lost, time is lost, and even taped product is lost.

SUMMARY OF THE INVENTION

A tape dispenser for an agricultural/industrial environment having wind and dirt dispenses tape adhesive side upwardly exposed. Centrally of the dispenser there is placed a roll of tape conventionally wound in a spiral. The roll of tape has an outwardly exposed adhesive release surface and an inwardly exposed adhesive coated surface and is wound in a first direction. In the dipenser, the tape is threaded from the first direction of its spiral wound path to a reversed path around the roll in a second and opposite direction. Typically, the reversed path is defined over the surfaces of four rollers with the adhesive release side inwardly exposed to the rollers and the adhesive coated side outwardly exposed. The roll and reverse path are encased within a housing to prevent the outwardly exposed adhesive from adhering either to ambient dust or nearby objects. The tape passes free from the housing along a dispensing path to a convention severing tape knife. The dispensing path includes a section open to the interior of the casing which allows the adhesive release side of tape on the dispensing path to attach to a small portion of the exposed adhesive on the reversed path. Thus, the tape is held by adhesive at the adhesive release coating and can be dispensed from the dispensing path and firmly held in the vicinity of the severing knife when tape is severed.

Other Objects And Advantages

A primary object is to disclose a tape dispenser for dispensing tape adhesive side up.

Yet another object of this invention is to disclose a tape dispenser which can be used in wind conditions found in many agricultural environments. According to this aspect of the invention, the tape as it passes along its reverse path is placed in a case. The case opens to a dispensing path typically terminating in a serrated knife. In the vicinity of the knife, there is exposed a small portion of the tape on the reverse path. This tape captures the reverse tape in the vicinity of the severing knife. The case protects the tape wound along its reverse path while enabling dispensing to occur in a high wind environment.

It has been found desirable to leave a section of the tape exposed adhesive side up adjacent the severing path. This section of tape should be long enough to ensure adherence of the tape to an object to be wrapped or bound, and once so adhered to ensure release of the tape from the dispensing path.

Other objects, features and advantages of this invention will be apparent after referring to the following specification and attached drawings.

DESCRIPTION OF THE SPECIFIC EMBODIMENTS

Figure 1A:
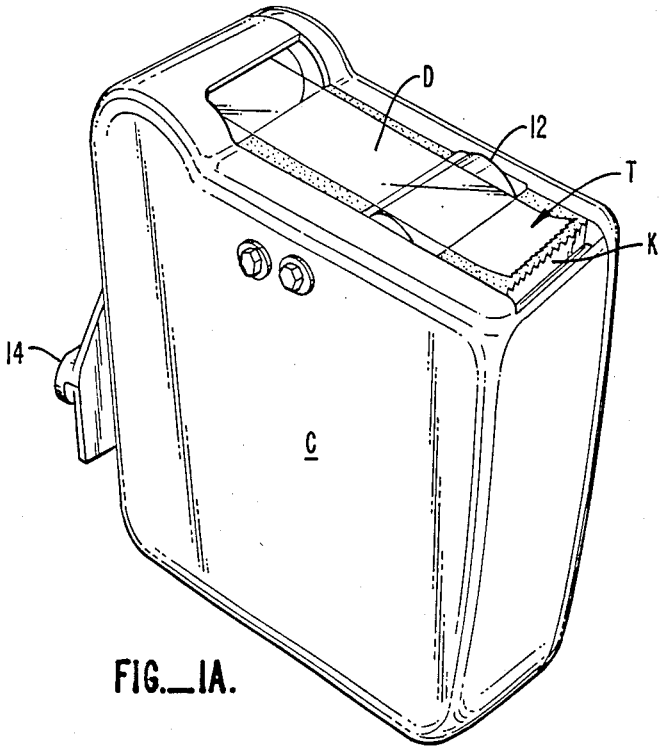
FIG. 1A is a view of the tape dispenser of this invention with the case closed.

Referring to FIG. 1A, a case C having a mounting bracket 14 encloses the tape dispenser of this invention. Typically, tape passes along a dispensing path D. As will hereinafter be more fully developed, a small section of upwardly exposed adhesive 12 maintains the tape T to the dispensing path D in the vicinity of a tape severing knife.

Figure 1B:
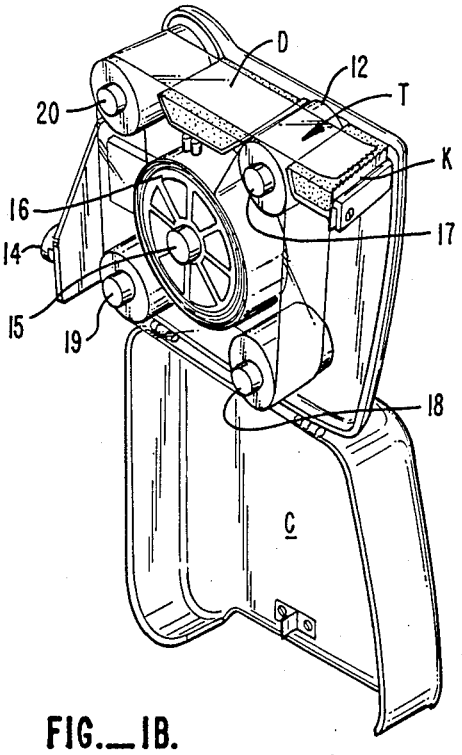
FIG. 1B is a view of the tape dispenser of FIG. 1A illustrating the dispenser opened and the disclosed path.

Referring to the view of FIG. 1B, the tape dispenser can be fully understood. A central hub 15 holds a tape roll 16 conventionally wound for dispensing. With respect to the roll, the tape is wound with the adhesive release surface outwardly exposed and the adhesive coated surface inwardly exposed.

The tape passes from the inner roll 16 into a reversed path about the roll. The reversed path passes over four rollers. These rollers are first roller 17, second roller 18, third roller 19, fourth roller 20. In this reversed path, it will be understood that the adhesive release surface is inwardly exposed. The adhesive surface is outwardly exposed.

The majority of the reversed path is encased within the hinged case C when the dispenser is utilized. This encasement prevents the outwardly exposed adhesive from either becoming dirty or adhering to nearby objects.

As the tape passes from roller 20 to and towards the severing knife K, it will be seen that a small segment of roller 17 extends above the dispensing path D. This being the case, the tape on the reversed path with its outwardly exposed adhesive surface captures the adhesive release surface of the tape T on the dispensing path D. The tape is firmly held in the vicinity of the knife K.

It will be observed that between knife K and roller 17, the path length of the dispensing path D is important. It has been found that the length of this path enables an object for wrapping to be placed on the tape, and the tape to be lifted from its engagement with roller 17 at the underlying adhesive exposed surface. Thus, an agricultural/industrial worker may depress an object, such as a bag, being wrapped between roller 17 and knife K on the tape to cause the tape to be lifted. Thereafter a working length of tape may be withdrawn, used for taping and severed at the knife with a downward motion.

It will be noted that the length of tape between roller 17 and the knife K is important. Specifically, this length of tape is to enable convenient detachment of the dispensed tape.

Specifically, a worker will take an object to be wrapped and place it on the tape between roller 17 and knife K. The length of tape will be sufficient so that upon upward movement of the object the adhesive on the dispensed tape will stick to the object. The length and amount of adhesive that sticks to the object will enable detachment of the adhesive release surface from the inward portion of tape disposed around roller 17. Thus an automatic detachment of the tape from the secured position will occur.

As roller 17 is raised slightly above a linear path between roller 20 and knife K, severing with sticking may be easily accomplished. Specifically by moving the wrapped object downwardly so as to sever the tape at the knife, secure reattachment of the loose tape at roller 17 also occurs.

Referring to FIGS. 2A–2D, it can be seen that the disclosed invention will admit of a number of configurations.

Figure 2A:
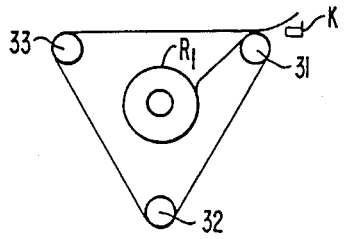
FIGS 2A–2D are alternative pathways for the disclosed tape.

Referring to FIG. 2A, a roll R1 has a reverse path around three rollers, 31, 32, and 33, to a severing knife K.

Figure 2B:
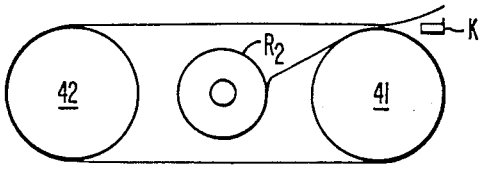

Referring to FIG. 2B, a roll R2 has a reverse path around two rollers, 41, 42, to the severing knife K.

Figure 2C:
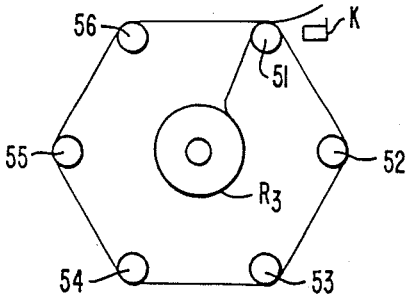

Referring to FIG. 2C, a roller R3 has a reverse path around six rollers, 51–56, to a knife K.

Figure 2D:
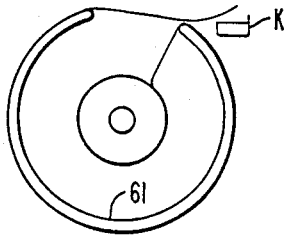

Finally and referring to FIG. 2D, a smooth "endless" surface 61 leads the tape around to a severing knife K. It is important to note that in this embodiment no rollers are actually utilized.

What is claimed is:

1. A process for dispensing tape comprising the steps of;

mounting a roll of spirally wound tape to a centrally disposed roller, said tape having an adhesive coated surface inwardly exposed and an adhesive release coated surface outwardly exposed;

passing said tape around said roll along a first dispersing path with said adhesive release coated surface disposed towards said roll of tape and said adhesive surface exposed outwardly from said roll of tape;

providing a second dispensing path terminating in a knife;

and placing said dispensing path to pass over a portion of the outwardly exposed adhesive surface from said first dispensing path whereby the adhesive release surface of the tape on said second dispensing path adheres to the outwardly exposed adhesive suface on said tape at said first dispensing path to maintain said tape on said dispensing path.

2. A tape dispenser comprising a central roll of tape wound in a spiral, said tape having an adhesive release surface outwardly exposed and an adhesive coated surface inwardly exposed;

a reversed path for said spiral roll of tape, said reversed path including means for passing said adhesive release surface of said tape in a path about said roll to a dispensing path;

a severing knife adjacent to the end of said dispensing path; and a small segment of said tape exposed from said reversed path to said dispensing path to enable said tape on said dispensing path to be held at said adhesive release surface.

3. The invention of claim 1 and wherein said reversed path about said tape roll is placed within a case, and said case defines an opening to said dispensing path.

4. Apparatus for dispensing tape from a spiral wound roll, said apparatus for being disposed about said roll and comprising:

means for rotatably mounting said roll to said dispensing apparatus;

means for defining a first path about said roll for enabling the tape to pass an adhesive release surface down about said roll, said path terminating in a second and dispensing path;

the second dispensing path including a knife; said second dispensing path overlapping a section of an upwardly exposed adhesively coated surface of the tape from said first path, said upwardly exposed adhesively coated surface for confronting and maintaining the adhesive release surface on the tape at said dispensing path to enable said tape to be held to said dispensing path.

5. The apparatus of claim 3 and including a cover, said cover disposed about said first path, having said dispensing path exterior of said cover, and defining an opening to allow tape on said dispensing path to adhere to the tape on said first path.

* * * * *